US010603781B1

(12) United States Patent
Price

(10) Patent No.: US 10,603,781 B1
(45) Date of Patent: Mar. 31, 2020

(54) SEGMENTED ERGONOMIC IMPLEMENT HANDLE SYSTEM

(71) Applicant: Leroi Kramer Price, Saint Cloud, FL (US)

(72) Inventor: Leroi Kramer Price, Saint Cloud, FL (US)

(73) Assignee: LeRoi Kramer Price, Saint Cloud, FL (US)

( * ) Notice: Subject to any disclaimer, the term of this patent is extended or adjusted under 35 U.S.C. 154(b) by 0 days.

(21) Appl. No.: 16/400,669

(22) Filed: May 1, 2019

(51) Int. Cl.
*B25G 1/04* (2006.01)
*B25G 1/10* (2006.01)
*B25G 1/06* (2006.01)

(52) U.S. Cl.
CPC ..... *B25G 1/102* (2013.01); *B25G 1/04* (2013.01); *B25G 1/06* (2013.01)

(58) Field of Classification Search
CPC . B25G 1/04; B25G 1/043; B25G 1/10; B25G 1/102; B25G 3/02; B25G 3/04; B25G 1/00; B25G 1/06
See application file for complete search history.

(56) References Cited

U.S. PATENT DOCUMENTS 1,107,523 A * 8/1914 Jackson ..... B25G 1/04 16/110.1
2,235,792 A * 3/1941 Bauman ..... A47J 45/08 16/431
4,325,157 A * 4/1982 Balint ..... B05C 17/0205 15/144.4
5,288,161 A * 2/1994 Graves ..... B05C 17/0205 15/145
5,873,148 A * 2/1999 Arnold ..... B25G 1/043 16/422
6,023,812 A * 2/2000 Morad ..... A47L 13/52 15/257.1
6,314,617 B1 * 11/2001 Hastings ..... A01K 87/08 16/436
2008/0072711 A1 * 3/2008 Toole ..... B25D 1/045 81/20
2010/0095487 A1 * 4/2010 Gitman ..... B25G 1/102 16/430
2016/0202017 A1 * 7/2016 Corbet ..... F41C 23/16 42/71.01
2016/0288310 A1 * 10/2016 Larouche ..... B25G 1/04
2017/0136617 A1 * 5/2017 Lucas, Jr. ..... B25G 1/06

* cited by examiner

*Primary Examiner* — Emily M Morgan

(57) ABSTRACT

This is a system to customize an implement handle's size and outer contour to the specific requirements of an individual user and thus improve the handle ergonomics. Disk shaped handle segments, with a central aperture, are stacked onto the tang of the implement and firmly held in place with a butt cap. The handle segments have various sizes of width, height, and thickness which may be mixed and matched to create a multitude to handle sizes and shapes. The segments can be disassembled and reconfigured since they are not permanently fastened to the implement.

11 Claims, 7 Drawing Sheets

FIG. 7
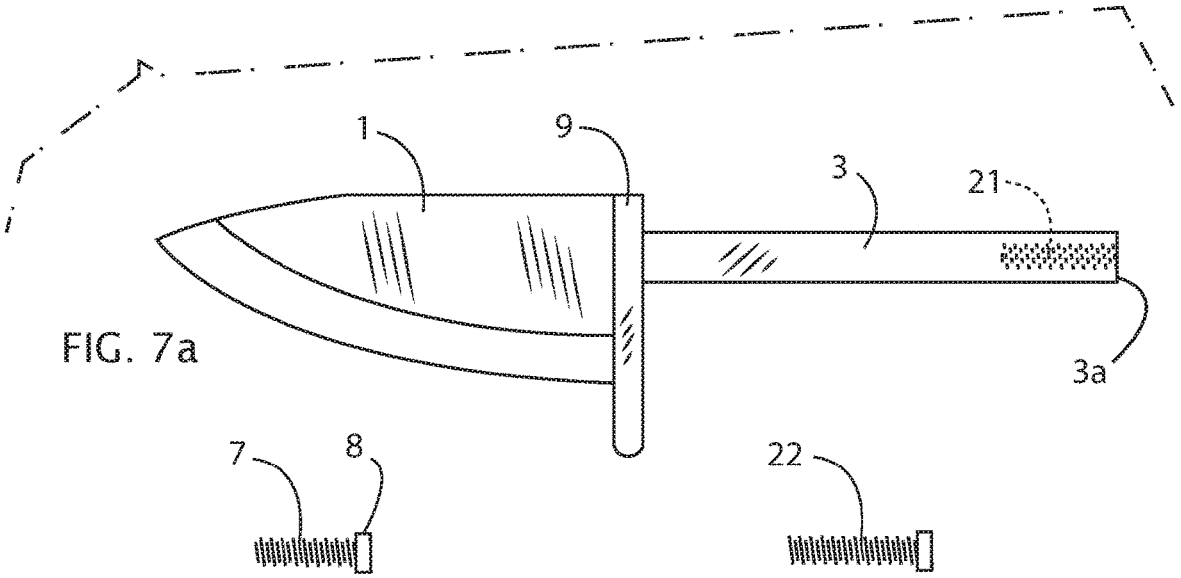
FIG. 7a
FIG. 7b
FIG. 7c
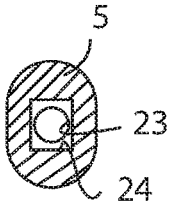
FIG. 7d
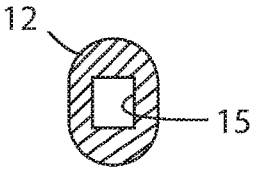
FIG. 7e
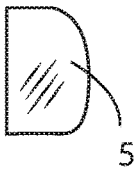
FIG. 7f
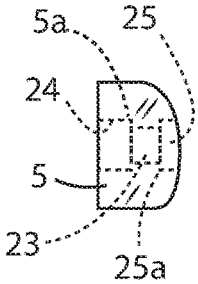
FIG. 7g
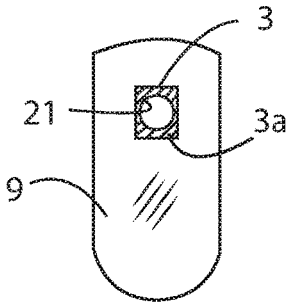
FIG. 7h
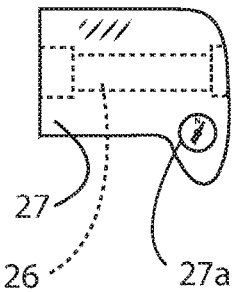
FIG. 7i
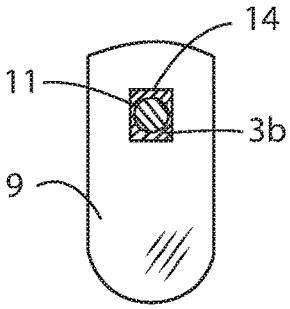
FIG. 7j
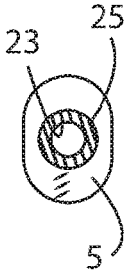
FIG. 7k

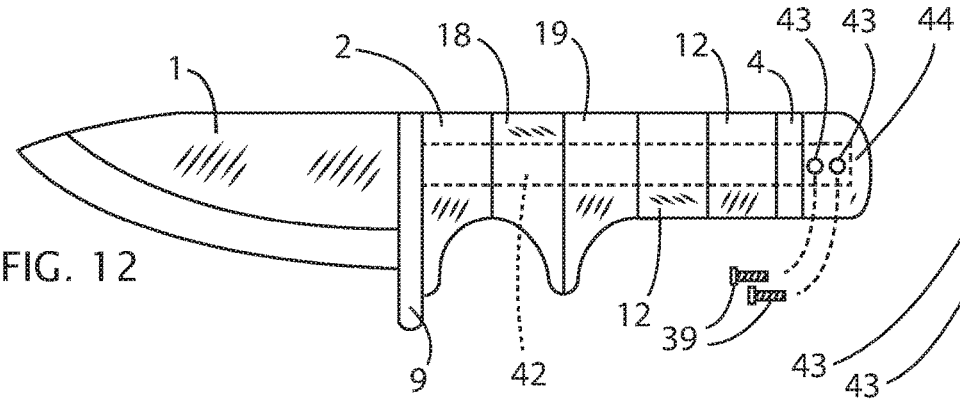
FIG. 12
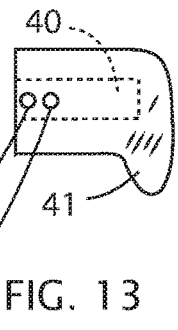
FIG. 13
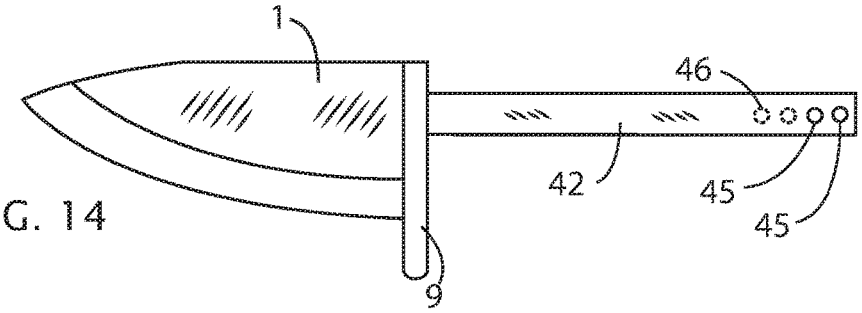
FIG. 14
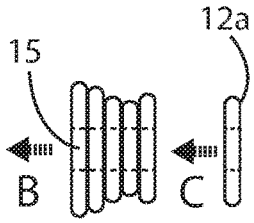
FIG. 14a
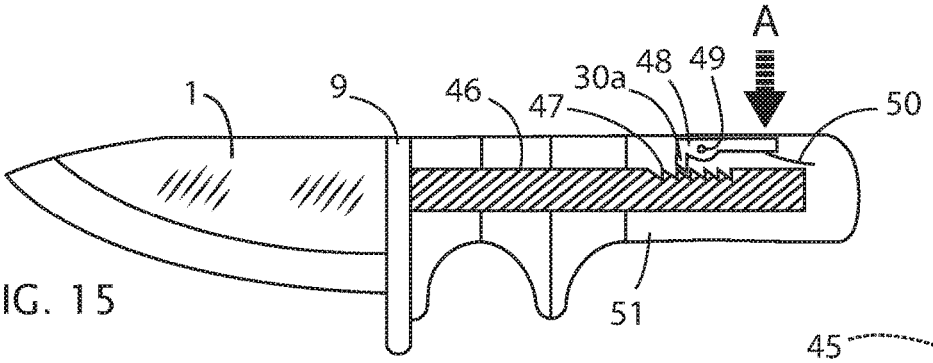
FIG. 15
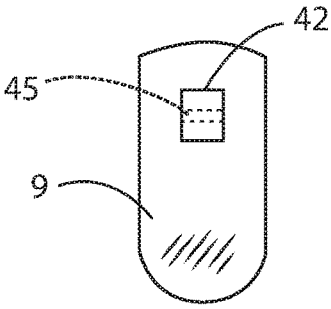
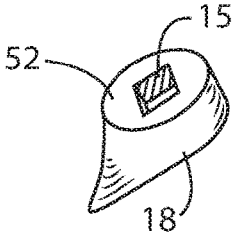
FIG. 16
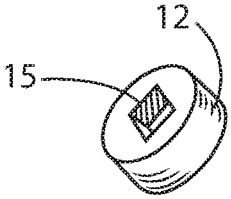
FIG. 17
FIG. 18

SEGMENTED ERGONOMIC IMPLEMENT HANDLE SYSTEM

FIELD OF THE INVENTION

This invention pertains to handles which are used on cutting tools, garden tools, or basically any implement that uses an elongated handle, for example: garden trowels and kitchen knives.

BACKGROUND OF THE INVENTION

Ergonomics of the tool handle have existed since the beginning of time. Couple those ergonomics with many other tool considerations such as the manufacturing costs of the tool, variations of the work place environment such as temperature, moisture, and body size of the worker, and then a multitude of tool design problems emerge.

The most common tool handle, and easiest to manufacture, is a round stick. Like a broom handle. It is the cheapest to make as well. This shape is easy to hold, versatile, and comfortable in many situations. But this basic handle shape can turn into an ergonomic disaster, causing pain, suffering, and loss of productivity. A larger handle, or smaller handle, might provide better ergonomic function to certain individuals and thus prevent fatigue and injury. Or a handle with contoured finger grooves could solve many task specific problems. Gloves are made in different sizes: small, medium, large, extra large. But even gloves are not always available in all sizes due to factors such as inventory cost. And likewise for every tool to be made with a custom shaped handle, small, medium, fat, thin, curved, etc., the cost would be prohibitively expensive.

The advantage of this current invention is that many handle forms can be quickly and easily changed to a desirable, more functional ergonomic form. Especially advantageous is that the size in both length and width, and even the contour shape of the handle can be transformed to custom fit an individual worker for their best ergonomic function.

Particularly in the of case of hunting knives, there is a common scenario where a young person is gifted a knife for camping trips, that is rarely used. Then years before the knife blade wears out, the person will grow, mature, and their hands will be too large to fit the knife handle. It would be most practical if a hunting knife handle could be adapted to be longer, and thicker to then fit an adult person's hand. Furthermore, the knife could be again passed down from an older person, male perhaps, to a smaller and younger person as a female with a smaller hand size. The handle could be adapted to be smaller or larger as needed for many years.

For production work, using a knife for example, the handle could be altered to best fit an individual workers hand or best fit to meet specific tasks such as working at shoulder height as opposed to overhead. Knife handle ergonomics are not very important for such tasks as cutting just one tomato in the home kitchen. For this reason handle ergonomics are sometimes ignored. However it is well known that for an 8 hour shift, in occupations such as a butcher, working in the cold, the daily activity can not only be painful, but improper ergonomics can in some workers actually lead to permanent injury to the tendons, joints, and muscles. Productivity at the workplace can suffer due to pain but also result in diminished quality of life.

There are numerous examples from garden tools, kitchen knives, ski poles, to drum sticks, where the issue of getting the ergonomics "just right" is important for maximum performance and avoidance of physical injury.

The current invention provides for a multitude of adjustments which can easily and quickly be "custom fit" to an individuals grip. It allows for experimental trials of creating different handle shapes in accordance to the physical stresses of different tasks, without difficult transformative procedures such as the use of heat or epoxy injections.

The best method to provide a customizable implement handle will be to provide a "kit" comprising of the main tool with a numerous handle segments having various widths, contours, and thicknesses. As opposed to the main implement component, such as a knife blade, which is expensive to manufacture, the handle segments can be made cheaply. And, therefore, a multitude of segments can be provided. These handle segments can be stacked onto the knife or implement tang, like puzzle pieces, in any desired order. Segments can also be turned end for end to provide a vast number of possible handle configurations. The desired handle shape can be rearranged again and again, at no additional cost.

PRIOR ART

Straight blade knives and tools with elongated handles have surely been around since the dawn of our civilization. And handle styles are numerous. The one main issue of this basic handle concept is that such handles are permanently attached to the implement and can not be altered to better fit the ergonomics of the user.

In an attempt to provide a solution to improving ergonomics, there has been presentations such as U.S. Pat. No. 6,314,617 by Hastings. This design uses hollow disks of uniform size. The disks are identical in both thickness and width. The example where this method was applied was to a fishing rod handle. Which only resulted in minor sweeping changes in bend contours of the handle, but no change in width. Ergonomics are thus minimally altered. Furthermore the handle requires a sheath like cover which further limits the end result of it's adjustability.

Patent 2017/0136617 by Lucas is conceptually the same method as Hasting with the use of uniform disks, with therefore the same limitations of only being able to make minor changes in handle shape and ergonomics. And the two systems have other identical features, thus having the same limitations of the disk positions being loosely held by friction, not firmly fixed in the short axis handle location. This loose fixation will allow the handle configuration to be insecure.

Patent 2009/0320639 by Segato et al. also uses uniform size segments intended to only adjust the length of the handle on a "sports" bicycle handlebar. Such a system would be of no use as an implement handle. The demands on an implement handle are much more complex and intense.

U.S. Pat. No. 5,873,148 by Arnold uses segmented handle pieces over a central sleeve. These segments are slideable in the long axis of the handle and are not firmly fixed to the sleeve. This limits the physical force that can be applied to the handle to only pulling in the short axis direction, such as pulling on a ratchet wrench handle. It cannot be adapted to other implements which encounter forces in the long axis direction. Alteration of ergonomics is thus also minimal.

These flexible designs in prior art are useful but only alter the handle ergonomics to a minimal degree and for handles mostly intended for light duty such as chef knives and fishing poles. The resulting shape of some of these handles are often only loosely held. They are of no use for constructing a sturdy handle intended for heavy duty tasks such as hunting knives and garden tools. These type of implements encounter forces of push-pull, twisting, and tight hand gripping.

The prior art of any stronger handle designs, like those resembling broom handles, offer little or no meaningful adaptability to effect ergonomics. The mechanics of the current invention have greater ability to withstand physical forces of heavy duty use and offer significant adaptability.

Also there is a greater limitation of materials that can be employed in the handle segments of the prior art of which are not exempted from employment in the segments of the current invention. The current novel invention allows for a wide range of harder or softer durometer of materials for better ergonomics, or situations when different strengths of materials, shatter resistance, or durability characteristics are required. As opposed to the design by Hastings using an outer sheath, handle segments may be made of different materials such as a robust inner core covered by an outer resilient exterior.

Plastic and rubber materials quickly decompose over time. When a tool handle destructs, the tool often can not be repaired and must be discarded. Replacement handle segments can restore tool inventory and do so cheaply at great saving to the company or individual. Segments can be mass produced for example by injection mold methods or singularly made from solid materials by CNC machining.

The handle can be easily disassembled for cleaning if needed.

BRIEF SUMMARY OF THE INVENTION

This invention uses segments that are stacked onto a central spine, or tang, to form an implement handle, and are firmly held together temporarily by a mechanical means. The tang has a shape preferably other than round, to prevent the turning of the handle segments in the short axis of the handle. The segments have a central hole, the shape of which matches the outer shape of the tang. The segments have a length and width, the dimensions both of which can be uniform or varied. Variations of the segment dimensions will thus vary the dimensions of the implement handle formed as well as it's outer contour. By stacking different shaped handle segments together in a coordinated manner the final handle shape achieved can be a customized handle which accommodates a person's specific hand size and shape. In so doing an ergonomically superior grip can be achieved for a multitude of individuals. The order of these segments can be switched around, as well as the segments turned end for end, providing many options for different handle shapes. There are at least two, preferably several handle segments to be used in implement handle formation. The segments can be made of inexpensive material, which, therefore can be sold as a handle kit with a numerous variety of widths and contours provided in a kit. Therefore for a handle that is for example formed out of 8 handle segments, a kit supplied containing 24 various handle segments could potentially form at least a dozen or more combinations.

The length of the handle can also be adjusted by use of butt caps of various lengths. These can also be used to vary the outer contour of the handle.

No glue is needed to assemble the segments. A locking device is used to fasten the butt cap on to the end of the tang. This keeps the handle segments temporarily but firmly fixed to the tang Locking devices to hold the butt cap on the tang can be such as a screw or screws, in either the short or long axis, locking levers with latches, a threaded tang end connecting to a threaded butt cap, sliding bolt, or other suitable means.

A locking lever mechanism can employ one or more levers, either mountable on the top, bottom, side, of the butt cap, or be situated in a combination of these locations.

The lever arm of the butt cap has a hook, or latch, which engages a notch. The locking lever mechanism may have the opposite arm of the lever exposed for easy access, or be concealed, with only a small aperture accessible by a small tool, so as to avoid accidental disengagement.

Release of a locking device on the butt cap allows disassembly of the handle. At this point the handle can be cleaned and/or the handle segment switched or replaced in order to reform the configuration of the handle.

BRIEF DESCRIPTION OF THE DRAWINGS

FIG. 2 is a view of a knife with the handle segments held on by a butt cap that screws on.

FIG. 5 is a side view of a butt cap with internal treads that screws on.

FIG. 7 is of various knife and handle components.

FIG. 7*a* is the left side view of the knife and tang assembly as in FIG. 1 with the handle segments removed. This embodiment uses a rear screw to attach the butt cap onto the tang.

FIG. 7*b* is a side view of the attachment screw for the butt cap used in FIG. 1.

FIG. 7*c* is the screw as in FIG. 7*b* but longer intended for a longer butt cap.

FIG. 7*d* is the frontal view of the butt cap of FIG. 7*g*.

FIG. 7*e* is the front or rear view of the handle segment in FIG. 6.

FIG. 7*f* is a view of the left side of the butt cap of either FIG. 5 or FIG. 7*g*.

FIG. 7*g* is a left side view of the butt cap used in FIG. 1 which shows the internal holes.

FIG. 7*h* is a rear view of the knife and tang assembly and guard of FIG. 7*a*.

FIG. 7*i* is a left side view of an alternate butt cap that is longer and also electively contains a compass, and also shows the internal holes.

FIG. 7*j* is a rear view of the knife and handle assembly and guard used in FIG. 2.

FIG. 7*k* is a rear view of the butt cap in FIG. 7*g*.

FIG. 12 is a left side view of the handle and knife using a butt cap that is attached with lateral screws.

FIG. 13 is a left side view of an alternate butt cap that is similar to FIG. 12 but longer and having different contour.

FIG. 14 is a left side view of the knife blade and tang assembly used in FIG. 12.

FIG. 14*a* is a partial handle assembly to demonstrate how thin segments can be stacked as well as segments having different edge contours such as the rounded example as shown on these.

FIG. 15 is a left side view of an alternate butt cap as used in FIG. 8 except using just one lever latch not two.

FIG. 16 is a perspective view of a handle segment that is significantly contoured and will subsequently form a contoured handle assembly.

FIG. 17 is a perspective view of a handle segment that is substantially oval and not significantly contoured.

FIG. 18 is a rear view of the knife and tang assembly used in FIG. 14.

DETAILED DESCRIPTION OF THE EMBODIMENTS

Figure 1:
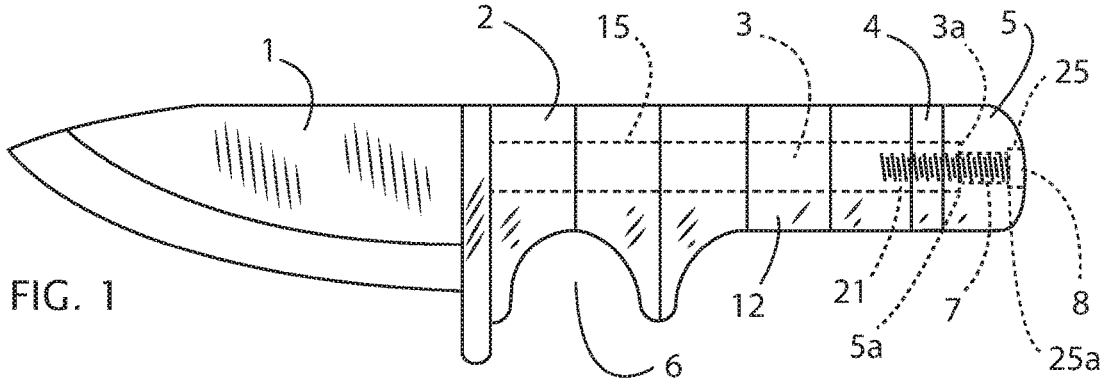
FIG. 1 is a left side view of a knife with the handle segments held on by a butt cap which is attached by a screw.

FIG. 1 is an assembled knife using a segmented handle. It's full description will be covered in FIG. 1-7.

FIG. 7*a* shows a blade and tang assembly that forms the basic starting component of this implement example. This is meant to be a generically represented implement that similarly could be a garden trowel, or hand rake, etc. As such, FIG. 7*a*, a knife with a straight blade, will be used to demonstrate an implement. The blade and tang assembly consists of a blade 1, and a tang 3, and an optional guard 9. Any common structure to bolster against the handle segments, such as a guard located at the front end of the tang, is likely suitable. This particular blade and tang assembly relates to the embodiment shown in FIG. 1 which uses a threaded hole 21 in the rear end of the tang. A screw 7 is screwed into threaded hole 21 as a means to fasten and hold the butt cap 5 onto the rear end of the handle. The butt cap is essentially a modified "handle segment" which is preferably not a flat disk segment. Handle segments are to be fully described later.

FIG. 1 the preferred embodiment shows the implement with the butt cap 5 in the fastened position. It is fastened by screw 7 which has a standard flat head 8 that is recessed into a recessed counter bore hole 25 into the rear end of the butt cap. The hole 25 is not a blind hole, however, it has a shoulder 25*a* which the screw head 8 abuts against, best demonstrated in FIG. 7*g*.

Optionally the head 8 of screw 7 may remain proud at the end of the butt cap and not be recessed. Head 8 may be contoured as needed to meet ergonomic demands.

FIG. 7*g* demonstrates the round hole 23 for the main shank of the screw 7, the recessed round hole for screw cap 8, and a front square hole 24, that receives the rear end of the tang 3 which also is square in this embodiment, and in which the rear end of the tang fits snugly into this hole. The front view of the butt cap is seen in FIG. 7*d*. Rear end view of the butt cap is seen in FIG. 7*k*.

This preferred embodiment uses a tang 3 that has a square cross section as is seen in rear end view FIG. 7*h*. A round shape can be used especially if there is a desire for the handle segments to rotate around the tang. However, any shape other than round is desired in order to prevent the handle segments such as 2, 4, 12, 16, 18, 19 from rotating. An oval shape, etc. can be used, or two or more tang shafts as desired to prevent rotation and add strength. Tang 3 may be hollow but is preferably made of solid material such as steel.

In butt cap 5 the central hole 24 has a square circumference and this hole also has a specific, extra, depth which will be described below. This square hole 24 is a space which is matched to the square cross section of the tang 3. The rear end 3*a* of tang 3 is held within this hole 24.

Figure 2:
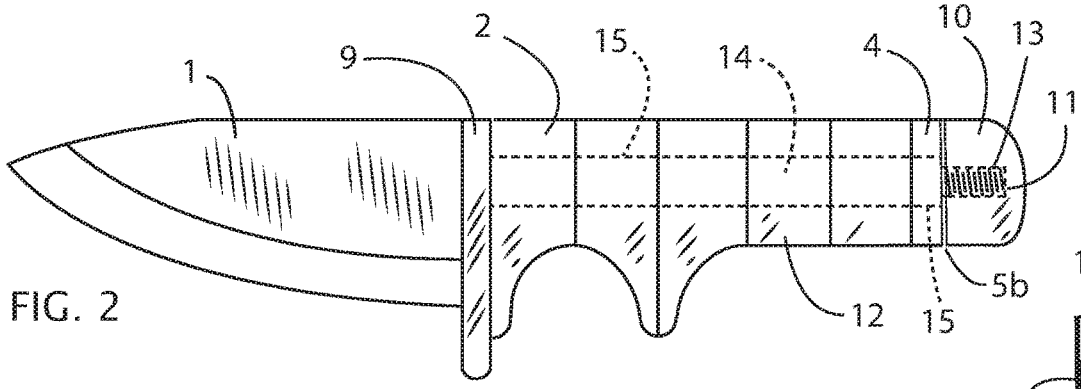
Figure 5:
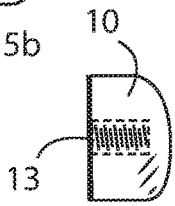
Figure 3:
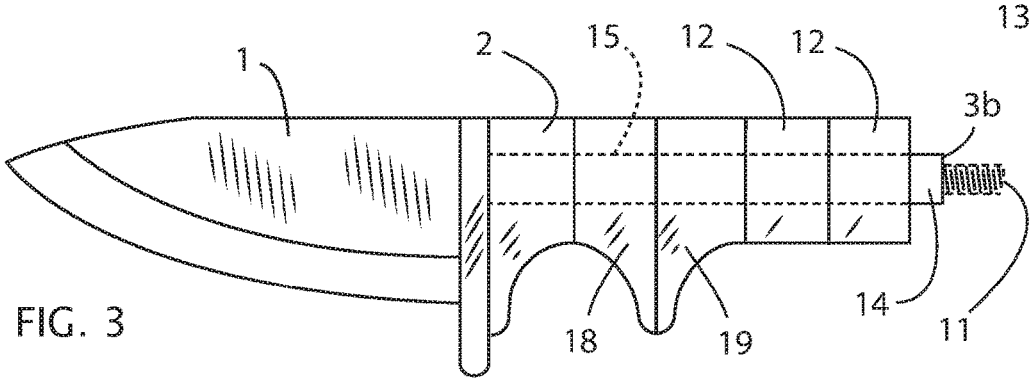
FIG. 3 is the knife in FIG. 2 with the butt cap and a thin handle segment removed.
Figure 6:
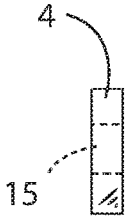
FIG. 6 is a side view of a handle segment that is thin.

An alternative fixation mechanism of the butt cap to the tang is seen in FIG. 2 and FIG. 3. Herein tang 14 has a threaded end 13 that butt cap 10 screws onto by means of it's threaded hole 13. The threaded portion 13 has an end 11 which must not be allowed to abut against the bottom of hole 13 otherwise a gap or space, which is depicted as 5*b*, will remain. And thus all the handle segments will be inappropriately loose.

The square hole 24 of butt cap 5 preferably has some extra depth at it's bottom surface 5*a*, FIG. 1, which prevents the end shoulder 3*a* of the tang 3 from making contact with 5*a* when the butt cap is fastened onto the tang. Therefore this will cause the desired contact between the front end of the butt cap and the rear end of the finale handle segment. Thus surface 3*a* and surface 5*a* preferably should not contact each other. Some extra space, already demonstrated as 5*b*, normally occurs between the rear end of the final handle segment and the butt cap. The example of some space is shown in FIG. 2 where the rear end of segment 4 and the front surface of the butt cap 10, in this case, do not make contact which creates a space 5*b*. This extra, virtual space 5*b* must be eliminated. The two surfaces between the butt cap and the final handle segment will fully contact each other due to the advantage of extra depth of hole 24, in that when screw 7 is tightened, all the handle segments can be pulled together snug and thus be fastened tightly together.

Handle segments are provided with a central hole 15 which, in these embodiments, is square, shown in segment 12, FIG. 7*e*, an end view. Formation of the implement handle is accomplished by the handle segments being placed onto the tang by sliding the tang 3 into these central holes. Once all the appropriate handle segments have been placed onto the tang, the handle can be secured by fastening the butt cap onto the rear of the knife. For this embodiment the assembled knife will look like FIG. 1, depending which handle segments are chosen to be used. Butt cap 5 is seen without depiction of ifs internal holes in FIG. 7*f*, with internal holes seen in FIG. 7*g*.

An alternative butt cap 27 is seen in FIG. 7*i*. This butt cap is longer which therefore creates a longer length handle if desired. It also has a different contour which further provides different ergonomics. The fastening concept is the same, however the round hole 26 is made longer since the butt cap is longer. To accommodate the need for a longer attachment screw a longer screw 22 is used, FIG. 7*c*. Replaceable butt caps can thus provide a length adjustment to the length of the handle, as well as different contours.

FIG. 7*i* also shows a compass 27*a* imbedded into the butt cap as a optional item. This is a method wherein further customization to the implement handle is possible.

Figure 4:
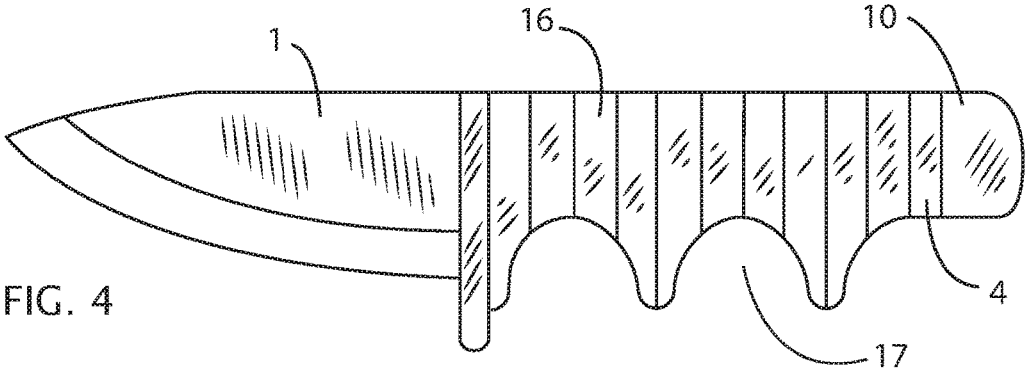
FIG. 4 is a segmented knife made of thin handle segments.

FIG. 1 and FIG. 2 show the most rearward flat handle segment 4 is a thinner segment compared to thicker segments such as handle segment 12. Variation of thickness of handle segments is advantageous for the purpose of more versatility to customize the handle length but also to obviate the potential problem of encountering a gap, such as gap 5*b*. By having the most rearward edge of the most reward handle segment adjusted in it's thickness to extend slightly further rearward to a point beyond the edge 3*b* of the tang, the butt cap 10 can thus cinch up the handle segments and prevent the handle segments from being loose. Likewise in the fastening system using butt cap 5, if the rearward surface 3*a* of tang 3 abuts the forward surface of butt cap 5 before a tight fastening situation can be achieved, then this gap can be eliminated by using a thicker handle segment prior to tightening screw 7. Thus a thin handle segment such as handle segment 4 can act as a shim and finely adjust the handle length. A thin segment need not be placed at the end of the stack of handle segments. It may be placed in a location more forward. There may also be a plurality of thin segments, such as seen in FIG. 4 and FIG. 14*a*, to further allow more customization of the outer contour of the handle. Such segments may also have variation in the outer contour, such as handle segment 16, for further possible customization.

Handle segments may take a specialized contour such as segment 2. Also contoured segments such as 18 and 19 may be turned end for end to achieve further versatility in handle customization. The segments are versatile since they have a central hole 15 seen in handle segment 18 in FIGS. 16 and 12 in FIG. 17, which keep the segments aligned.

Contoured handle segments, being arranged in appropriate sequence, can achieve complex ergonomic contours, as seen in the finger groove 6 in FIGS. 1 and 17 in FIG. 4.

Other contours can be applied having a plurality of shapes such as concave grooves to promote a better hand grip, as well as angled edges or convex or beveled edges such as segment 12*a* as seen in FIG. 14*a*. This concept would be especially useful in the method shown in the stacked assembly in FIG. 14*a* where very thin handle segments are employed which form a ribbed type handle grip along with having a customized handle thickness overall. Dotted arrow C show segments getting stacked together in FIG. 14*a*, then moved, arrow B, onto the implement handle 42 in FIG. 14.

There is a need for versatility in the means to fasten the butt cap onto the implement to accommodate different situations. Issues, such as speed and ease to disengage the butt cap versus safety against it getting loose and accidently disengaging are some considerations. Typically, the butt cap would not be removed and replaced frequently. Therefore the means to fasten the butt cap which avoids accidental disengagement but are cumbersome to purposefully disengage would be preferred, as long as the attachment it creates is sturdy.

Figure 8:
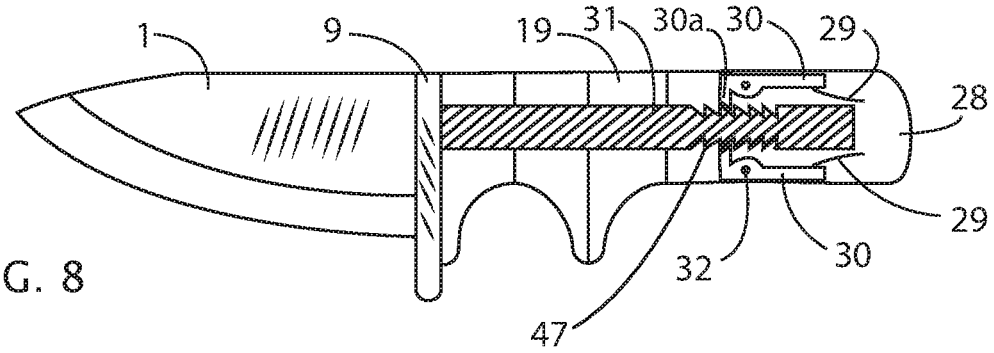
FIG. 8 is the left side of a cross-sectional view of FIG. 10 taken along line 8-8 of the of an alternate butt cap that uses two lever latches that are external.

An additional method to fasten the butt cap is seen in FIG. 8 using two latches 30, but any number is possible. Latches 30 are located within butt cap 28. The latches are located on the top and bottom of butt cap 28. But the same method could be used in other locations like on the right and left sides or a combination there of. The latches 30 act like typical levers, using pivot pins 32. The forward arm of the lever is biased to rotate inward because the rearward arm is biased to move outward by leaf spring 29. The forward arms of the levers have a hook shape 30*a*. This front hook 30*a* compatibly locks into the rack teeth 47 which are cut into the tang 31, thus securing the butt cap onto the tang.

Looking at FIG. 15, this is an alternate embodiment using one latch not two. In this internal view of the latch system, the hook 30*a* of the forward arm of lever 48 forms a tooth that engages the opposing rack teeth 47 of the tang 46.

This method of having not just one notch to engage the latch but a row of several rack teeth allows for adjustment of the handle length since the rack teeth provide several positions that may be used to lock the butt cap. With a long butt cap, as 51 or 28, there is more versatility of altering the length of the handle, however less versatility of using handle segments forward of the butt cap due to the shorter distance left over.

Figure 10:
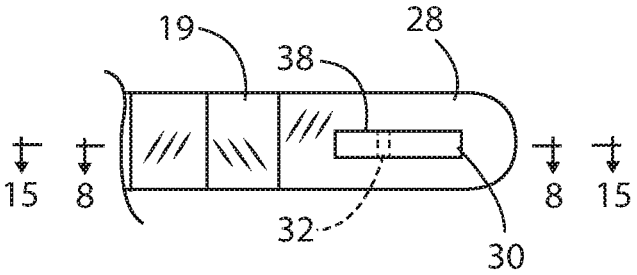
FIG. 10 is a top view of the butt cap used in FIG. 8.

The levers 30 can be easily disengaged since their outer surface is exposed through rectangular opening 38, seen in FIG. 10. The rear arms of levers 30, for safety reasons, can not be easily depressed with a finger tip, yet easy to depress with any common object such as a car key. By depressing the rear ends of the levers 30 the bias of their springs 29 will be overcome and the rear arms will then rotate inward, the forward arm will rotate outward, and thus unlatch the levers. When two levers are used they must be unlatched simultaneously, which provides additional safety from accidental disengagement.

Alternate butt cap 51 is seen in FIG. 15 which uses only one lever 48 but the same function having pivot pin 49 and biasing leaf spring 50 and tang 46 having rack teeth 47 is disengaged in the same manner.

Arrow A, FIG. 15 shows the inward force used to depress the rear end of the lever 48 which will subsequently raise the front end and unlatch the butt cap.

Leaf spring 29 may be replaced by other spring types, such as a coiled compression spring, which performs the same biasing function.

Figure 9:
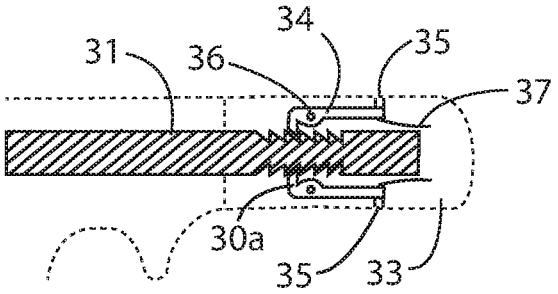
FIG. 9 is the left side of a cross-sectional view of FIG. 10 taken along line 9-9 illustrating a variation of the butt cap in which there are two latches which are internal.
Figure 11:
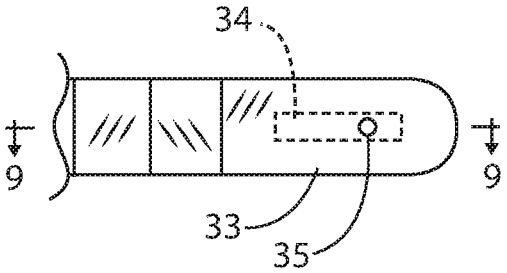
FIG. 11 is a top view of the butt cap used in FIG. 9.

An alternate butt cap 33 is seen in FIG. 9 which also uses two levers 34, but is suitable to use any number of levers, and uses biasing leaf springs 37 and pivot pin 36 fasten the levers 34 to the butt cap. The function is similar as that of butt cap 28 except the levers 34 are smaller and the pivot pins are located farther away from the outer surface of the butt cap. Therefore the levers are now internal, not exposed externally. Furthermore the levers 34 can only be reached via small access holes 35. The access holes 35 are small, FIG. 11, and thus inhibit the contact of the external surface to the levers 34. To unlatch the butt cap a small pointed tool is required, such as a paper clip or carpentry nail. This situation creates a very safe environment against accidental disengagement of the latches since the finger tips of the operator can not accidently unlatch the butt cap.

An alternate fastening system is seen in FIG. 12 where butt cap 44 has external screws 39 enter screw holes 43 and are captured in threaded holes 45 which are located in the end of the tang 42. More adjustment in the tang length is provided by the addition of multiple threaded holes 46, FIG. 14, which gives more choice to the location of where the butt cap can be attached. Further adjustment in handle length is possible by modified butt cap 41, FIG. 13, which can also provide alternate handle contours. Threaded hole 45 is also depicted in FIG. 18 which is the end view of FIG. 14. The screw hole 45 runs horizontal through tang 42, but could just as well be oriented in other directions such as vertical. Elongated hole 40 allows for the handle length to vary.

If firmer attachment of handle segments is desired, then the system using threaded holes 45 and external attachment screws 39 running through external holes 43 can be used in more or all of the handle segments, not just the butt cap. Also a mixture of other systems or methods can be used in different combinations to fixate some or all handle segments to the tang.

Figure 19:
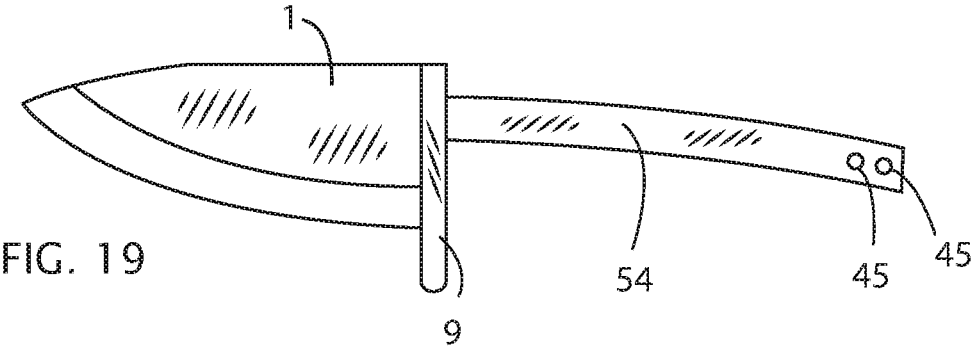
FIG. 19 is a left side view of a knife, guard, and tang assembly which uses a curved tang.
Figure 20:
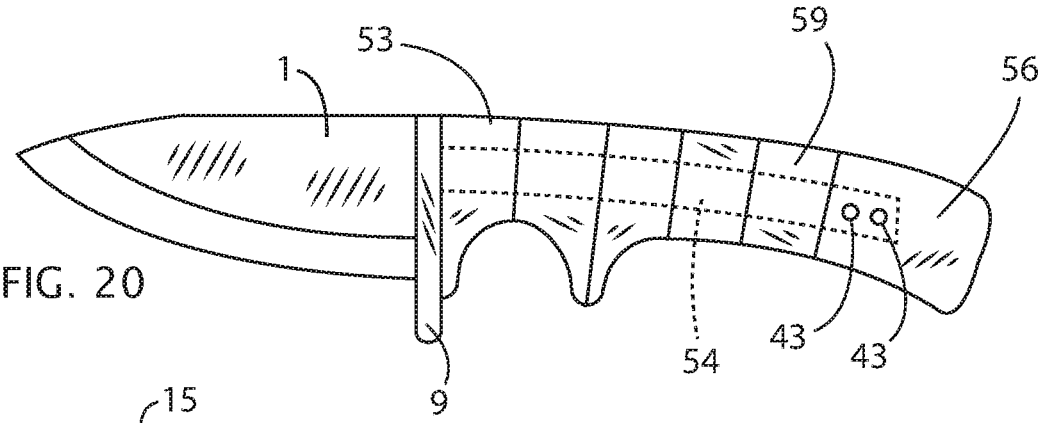
FIG. 20 is a left side view of handle segments used on the knife and tang assembly of FIG. 19.
Figure 21:
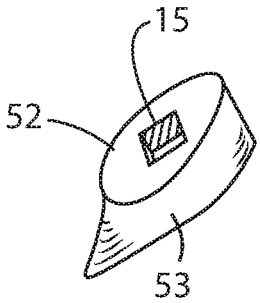
FIG. 21 is a perspective view of a contoured handle segment that has non parallel front and back sides which is appropriate to be use on the tang of FIG. 19.
Figure 22:
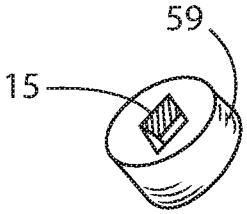
FIG. 22 is a perspective view of a handle segment that is substantially oval and not significantly contoured that has non parallel front and back sides in the same fashion as FIG. 21.
Figure 22A:
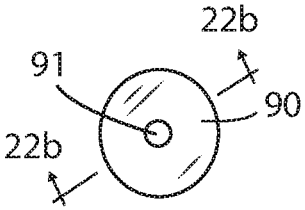
FIG. 22*a* is an end view of a simple disk with a threaded center hole to function as a butt cap.
Figure 22B:
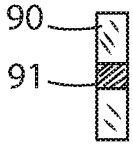
FIG. 22*b* is the disk of 23*a* cross-sectional view taken along line 22*b*-22*b*.
Figure 22C:
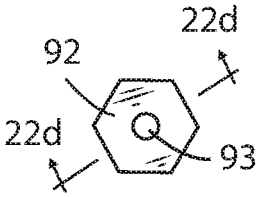
FIG. 22*c* is a common threaded hex nut that can function as a butt cap.
Figure 22D:
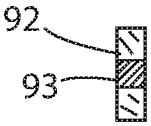
FIG. 22*d* is a cross-sectional view of the hex nut of FIG. 22*c* taken along line 22*d*-22*d*.

An alternate system of implement handle formation in which greater ergonomic curvature of the handle is desired than that which can be achieved by mere stacking of handle segments and thus alteration of their contour alone, is seen in FIGS. 19-21. The attachment system for butt cap 56 is similar to the recently discussed system of butt cap 44, however other methods can be used to attach the butt cap. The tang 54 has a curvature that the handle segments will follow. Some alteration of the parallel front and back sides as seen in previous handle segments will require slanting front and rear sides, so that the body of the handle segments assume a wedge shape, as seen in 53 and 59. Looking at handle segment 53, the flat face 52 will then abut the flat face of the handle segment that it is adjacent to on the tang and result in no gap between these handle segments. Threaded screw holes 45 function the same as on tang 42 FIG. 12 and FIG. 14.

Other butt cap systems are possible as seen in FIGS. 22*a*-22*d* in which a threaded round disk 90, or other shaped device, can be screwed onto threaded tang end 11 through threaded hole 91. Or just simply use a hex nut 92 with a threaded center 93 to be used on tang end 11.

Figure 23:
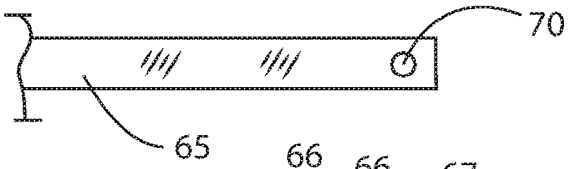
FIG. 23 is a side view of the tang used in FIG. 24.
Figure 24:
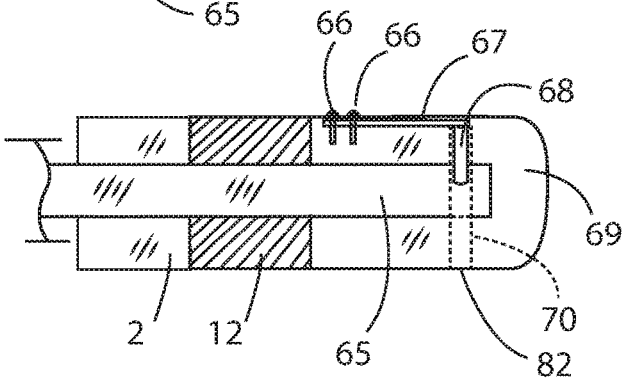
FIG. 24 is a view from above of a cross-section of an alternate butt cap in which the top of the butt cap and handle segments have been removed at the level of the tang to expose the use of a sliding bolt which is in the locked position.
Figure 25:
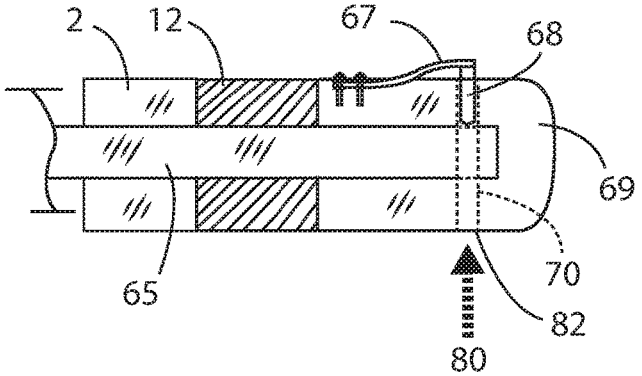
FIG. 25 is a view from above of a cross-section of an alternate butt cap in which the top of the butt cap and handle segments have been removed at the level of the tang to expose the use of a sliding bolt which is in the unlocked position.

An alternate latching system for the butt cap is seen in FIGS. 23-25 in which a spring biased pin holds butt cap 69 onto the tang 65. The latching pin 68 is attached to leaf spring 67 which is seen in the fastened position in FIG. 24. The spring is depicted external but may also be located internally within the butt cap, held by rivets or screws, 66. To achieve the unfastened position, seen in FIG. 25, a small tool is inserted into hole 82, as depicted by arrow 80, which will push the pin 68 out of to hole 70 and thus unfasten the butt cap. The likelihood of accidental unfastening is rare yet unfastening is easily accomplished. Fine adjustment is limited but additional holes 70 can be provided for that purpose. Other fastening cross pin systems are possible, such as through pins, with or without springs, but many such pins as may used with detents, wedging, or self contained springs are familiar to those skilled in the art.

Figure 26:
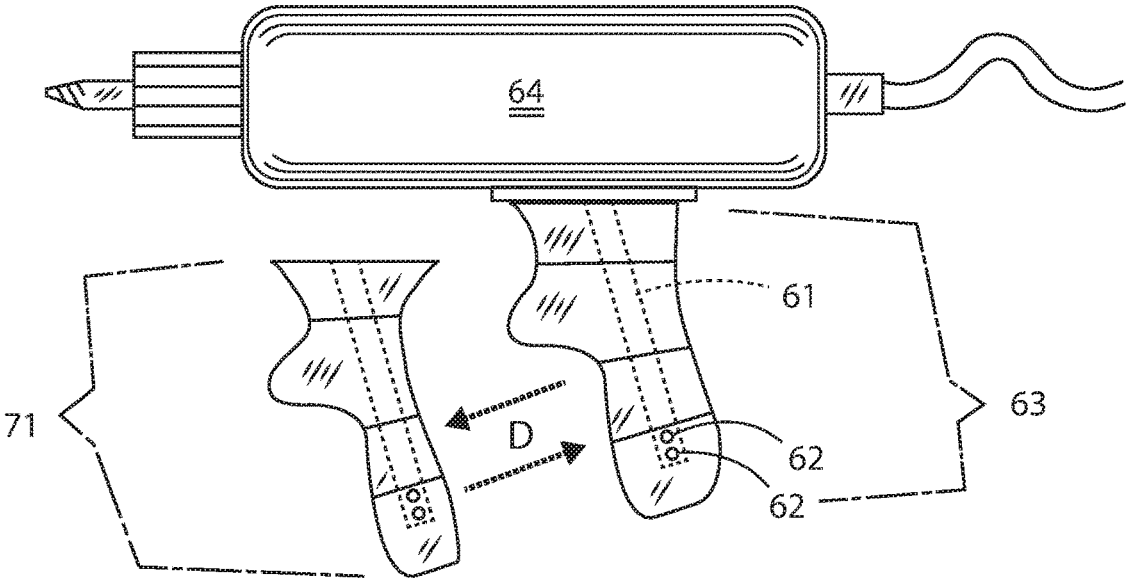
FIG. 26 is a view of a generic production tool that uses a customizable segmented handle.

The system of handle assembly can be adapted to other implements such as seen in FIG. 26. This is a generic representation of a factory production tool 64, which might be used for an 8 hour work shift. Although these production tools are constructed as ergonomically as possible, they are not individualized to any specific worker. The tool will require a central spine 61 which is the same concept as the tang on any hand tool. Strength requirements may require robust modifications such as a thicker shaft. An assembly of handle segments, such as assembly 63, can be swapped for another set of different segments such as assembly 71, easily at the beginning of employment of such a tool or even at the mere beginning of an 8 hour work shift. A method of fixing the butt cap is shown by using screws and holes 62. However, various methods can be chosen for this fastening task.

Arrows D demonstrate different handle configurations—being swapped on the tool.

Figure 27:
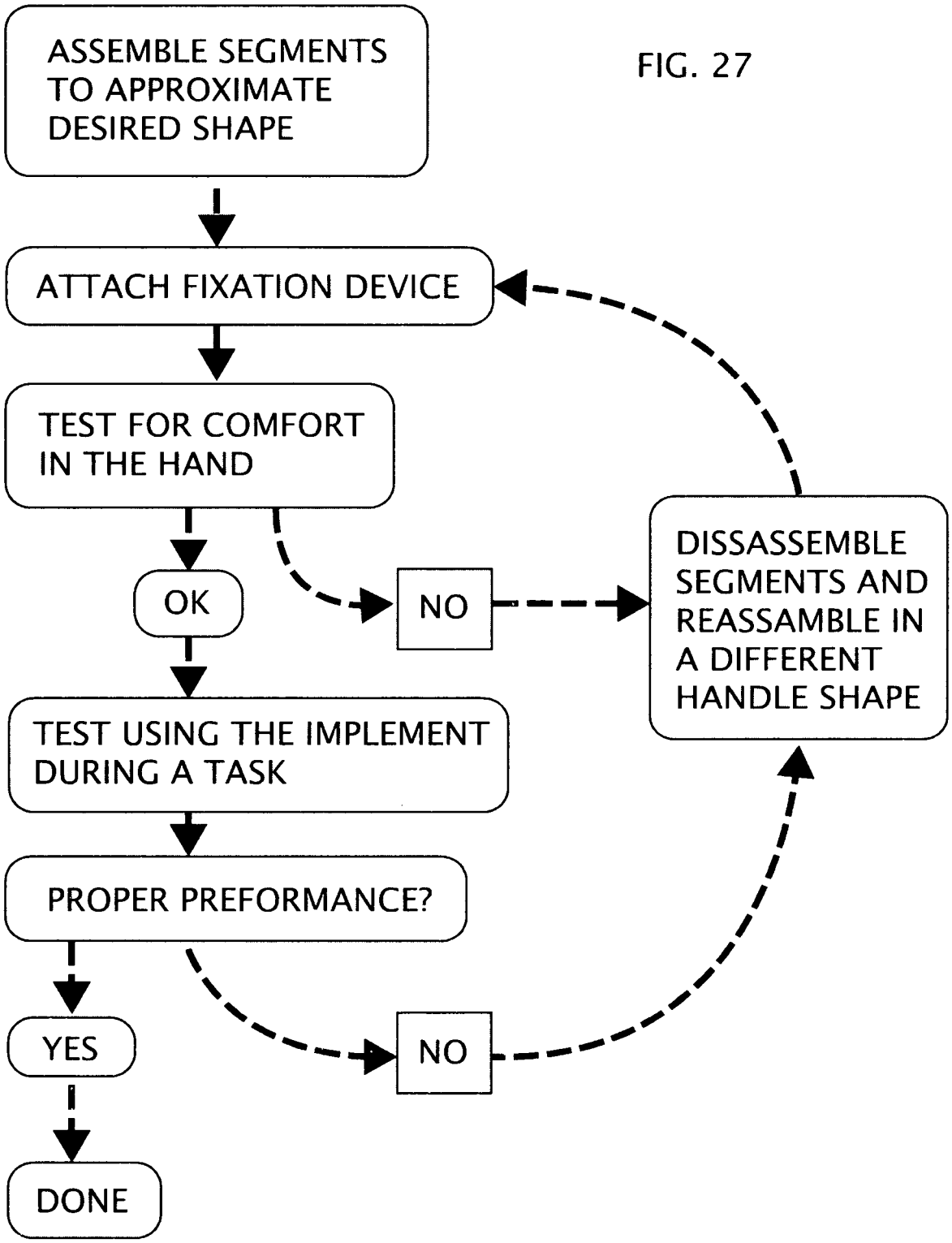
FIG. 27 is an algorithm for fitting and adjusting a segmented handle system.

FIG. 27 is an algorithm of how appropriate segments can be arranged. The segments can be sold in kits with several handle segments of different sizes and contours or a wide variety of segments can be ordered. Special handle segments may be fabricated to accommodate triggers or other devices.

Depicted here is only the basis of the adaptable handle segment system and is not limited to merely those examples as described. Other variations are possible to stem from these embodiments This system is adaptable to a multitude of hand tools in numerous applications and tasks Materials for handle segments have a wide range possibilities such as plastics, metals, and natural materials.

What is claimed:

1. A handle, comprising:

a tang comprising an elongated shaft having: a cross section, a front end attachable to an implement, and a rear end having structural modifications;

a butt cap having a releasable mechanical fastener;

a plurality of handle segments, each of the plurality of handle segments has an outer circumference and a front and a rear side, each of the plurality of handle segments having a central aperture extending through the front and rear sides, each central aperture having a cross section corresponding to the cross section of the tang, the cross section of the handle segments are sized to inhibit lateral shifting around the tang, each of the plurality of handle segments having an outer contour on the outer circumference, the outer contours of the plurality of handle segments have a plurality of different shapes, the plurality of handle segments can be reconfigured by a user to optimize ergonomics;

the cross sections of the tang and the plurality of handle segments have a shape configured to provide at least three rotational positions of the plurality of handle segments around the tang;

the structural modifications are configured to engage the releasable mechanical fastener;

the handle has an assembled and an unassembled configuration;

wherein in the unassembled configuration, the plurality of handle segments and butt cap are separated from the tang, wherein in the assembled configuration, the plurality of handle segments are applied to the tang via the central aperture, the butt cap is removably applied to the rear end of the tang using the releasable mechanical fastener, the butt cap retains the plurality of handle segments onto the tang.

2. The handle of claim 1, wherein each outer contour has a plurality of protuberances and indentations, the circumference of each segment has a variable dimension, a distance between the front and rear sides has a variable dimension;

the handle segments being reconfigurable in sequence and rotation around the tang to create a multitude of permutations are used to form a customized handle;

the segments once positioned on the tang being held firmly in location by attachment of the butt cap being unable to move axially or laterally.

3. The handle of claim 1, wherein the elongated shaft has a longitudinal shape selected from the group consisting of: straight, curved, and plurality of curves.

4. The handle of claim 1, wherein the handle segments comprise a hard inner core material and a soft resilient exterior material.

5. The handle of claim 4, wherein the resilient material of each handle segment is different.

6. The handle of claim 1, wherein the releasable mechanical fastener comprises: a lever having a front end with a latch, a central pivot, and a rear end, a spring biasing the front end toward the tang; wherein the structural modifications of the tang comprise at least one notch; wherein the latch engages the notch when the butt cap is applied to the tang.

7. The handle of claim 6, wherein the lever is located internal of an outer surface of the butt cap, the butt cap having an aperture exposing the rear end, the aperture is sized to receive a tool to engage the lever in a manner that releases the latch.

8. The handle of claim 1, wherein the releasable mechanical fastener comprises: a latching pin having a front end and a rear end, the latching pin is slideably attached to the butt cap, a spring engaging the rear end to bias the latching pin toward the tang; wherein the structural modifications of the tang comprises a hole; wherein the front end of the latching pin engages the hole when the butt cap is applied to the tang.

9. The handle of claim 1, further including a plurality of butt caps, each butt cap having a different exterior surface shape.

10. The handle of claim 1, wherein the releasable mechanical fastener comprises: at least one screw, the structural modifications of the tang comprise a threaded hole perpendicular to a length of the tang, wherein the screw engages the threaded hole when the butt cap is applied to the tang.

11. The handle of claim 1, wherein the releasable mechanical fastener comprises: a screw, the structural modifications of the tang comprise a threaded hole coaxial with a length of the tang, wherein the screw engages the threaded hole when the butt cap is applied to the tang.

* * * * *